US010815985B2

(12) United States Patent
Hrupp

(10) Patent No.: US 10,815,985 B2
(45) Date of Patent: Oct. 27, 2020

(54) MODULAR SUBSURFACE LIFT ENGINE

(71) Applicant: Exacta-Frac Energy Services, Inc., Conroe, TX (US)

(72) Inventor: Joze John Hrupp, Montgomery, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 147 days.

(21) Appl. No.: 16/220,391

(22) Filed: Dec. 14, 2018

(65) Prior Publication Data

US 2019/0195059 A1 Jun. 27, 2019

Related U.S. Application Data

(60) Provisional application No. 62/610,323, filed on Dec. 26, 2017.

(51) Int. Cl.
*F04B 47/08* (2006.01)
*E21B 43/12* (2006.01)

(52) U.S. Cl.
CPC ..... *F04B 47/08* (2013.01); *E21B 43/129* (2013.01)

(58) Field of Classification Search
CPC ..... F04B 47/08; F04B 47/10; E21B 43/122; E21B 43/126; E21B 43/129
See application file for complete search history.

(56) References Cited

U.S. PATENT DOCUMENTS

| | | | | |
|---|---|---|---|---|
| 3,160,209 | A | 12/1964 | Bonner | |
| 4,295,801 | A | 10/1981 | Bennett | |
| 4,487,258 | A | 12/1984 | Jackson et al. | |
| 4,778,355 | A * | 10/1988 | Holland | F04B 47/08 417/378 |
| 5,152,340 | A | 10/1992 | Clark et al. | |
| 5,797,452 | A | 8/1998 | Martin | |
| 5,810,082 | A | 9/1998 | Jordan et al. | |
| 5,904,207 | A | 5/1999 | Rubbo et al. | |
| 6,564,876 | B2 | 5/2003 | Vaynshteyn | |
| 7,341,111 | B2 | 3/2008 | Van et al. | |
| 8,336,615 | B2 | 12/2012 | Hughes et al. | |
| 2011/0052417 | A1 | 3/2011 | Wells | |

* cited by examiner

*Primary Examiner* — Kenneth J Hansen
(74) *Attorney, Agent, or Firm* — J. Bennett Mullinax, LLC

(57) ABSTRACT

A modular subsurface lift engine lifts hydrocarbons directly or indirectly from a cased wellbore. The modular subsurface lift engine has a surface drive system with a fluid pump that pumps a lift fluid into an isolated annulus of the cased well bore surrounding subsurface lift engine. A lift capacity of the subsurface lift engine is increased by increasing the number of lift engine modules.

20 Claims, 8 Drawing Sheets

MODULAR SUBSURFACE LIFT ENGINE

CROSS REFERENCE TO RELATED APPLICATIONS

Applicant claims the benefit to priority under 35 U.S.C. § 119(e) of provisional patent application 62/610,323, filed on Dec. 26, 2017.

FIELD OF THE INVENTION

This invention relates in general to liquid hydrocarbon lift systems and, in particular, to a modular subsurface lift engine adapted to directly or indirectly lift liquid hydrocarbons from a cased wellbore.

BACKGROUND OF THE INVENTION

Liquid hydrocarbon lift systems are well known and widely used to produce fluids from cased wellbores that lack sufficient natural well pressure to produce the fluids without a mechanical lift system. The most commonly used mechanical lift systems are downhole pumps, which include sucker rod pumps that connect to a bottom end of a production tubing, and insert pumps that are inserted into a bottom end of a production tubing string. The sucker rod pumps and the insert pumps are both driven by a "sucker rod string", which is a jointed slim rod string that reciprocates inside the production tubing string and connects the pump to a surface drive system. The surface drive system is typically a pumpjack, sometimes referred to as a "nodding donkey" or a "rocking horse". While such systems are both useful and reliable, they require a considerable amount of material to construct, require a complex drive system, and can be expensive to maintain. Furthermore, in highly deviated wells sucker rod strings tend to fail due to excessive wear in the curved sections of the wellbore. As well, downhole pumps have to be located above the kickoff point in horizontal well bores to prevent premature sucker rod failure and to keep the pumps in an upright orientation in which they function optimally.

There therefore exists a need for a novel cased wellbore lift system that overcomes many of the issues associated with prior art pumpjacks and associated surface and subsurface pumping equipment.

SUMMARY OF THE INVENTION

It is therefore an object of the invention to provide a modular subsurface lift engine adapted to be used to produce fluids from a cased wellbore.

The invention therefore provides a modular subsurface lift engine, comprising: an upper valve housing with an upper valve seat and an upper valve for controlling a flow of produced fluid hydrocarbons through the subsurface lift engine during a down-stroke thereof; an upper crossover sleeve connected to a bottom end of the upper valve housing; an upper transition sleeve connected to a bottom end of the upper crossover sleeve; an upper crossover tube connected to an upper travel limiter that reciprocates within the upper transition sleeve, the upper crossover tube extending through a central passage in a bottom of the upper transition sleeve; at least one subsurface lift engine module connected to a bottom end of the upper transition sleeve, respectively comprising a modular cylinder sleeve, a modular cylinder piston that reciprocates within the modular cylinder sleeve, and a modular cylinder tube connected to a lower side of the modular cylinder piston and extending through a passage in a modular cylinder sleeve bottom wall of the modular cylinder sleeve; and a lower crossover sleeve adapted to connect to a production packer that isolates an annulus of the cased well bore surrounding the modular subsurface lift engine from an annulus of a cased hydrocarbon well below the production packer.

The invention further provides a modular subsurface lift engine, comprising: an upper valve housing adapted to connect to a production tubing supported by a wellhead of a cased well bore, the upper valve housing having an upper valve seat and an upper valve for controlling a flow of produced fluid through the subsurface lift engine during a down-stroke thereof; an upper crossover sleeve connected to a bottom end of the upper valve housing; an upper transition sleeve connected to a bottom end of the upper crossover sleeve, the upper transition sleeve having an upper crossover tube that is connected to a bottom of a transition travel limiter, the crossover sleeve extending through a central passage in a bottom of the upper transition sleeve; at least one subsurface lift engine module connected to a bottom end of the upper transition sleeve and comprising a modular cylinder sleeve, a modular cylinder piston that reciprocates within the modular cylinder sleeve, and a modular cylinder tube connected to a lower side of the modular cylinder piston and extending through a passage in a modular cylinder sleeve bottom wall of the modular cylinder sleeve; and a lower crossover sleeve having a lower valve housing with a lower valve seat and a lower valve for controlling a flow of produced fluids through the subsurface lift engine during an up-stroke thereof, the lower crossover sleeve being adapted to connect to a production packer that isolates an annulus of the cased well bore surrounding the modular subsurface lift engine from an annulus of the cased well bore below the production packer.

The invention yet further provides a modular subsurface lift engine, comprising: at least one subsurface lift engine module adapted to be connected end-to-end to other subsurface lift engine modules, each subsurface lift engine module comprising: a modular cylinder sleeve having an open top end, a cylinder sleeve bottom wall with a central passage therein, and at least two cylinder sleeve ports adjacent the cylinder sleeve bottom wall to provide fluid communication through the modular cylinder sleeve with a modular cylinder lift chamber; a modular cylinder piston with a modular piston seal that provides a high-pressure fluid seal between an inner wall of the modular cylinder sleeve and the modular cylinder piston, the modular cylinder piston having an upper travel limiter and a lower travel limiter to limit travel of the modular cylinder piston in the modular cylinder sleeve; a modular cylinder tube connected to the bottom travel limiter of the modular cylinder piston and extending through a high pressure fluid seal in the central passage in the modular cylinder bottom wall, the modular cylinder tube having at least two modular cylinder tube ports that provide fluid communication through a sidewall of the modular cylinder tube with a modular cylinder pump chamber above the modular cylinder piston in an adjacent lower modular cylinder sleeve; an upper valve housing adapted to connect a production tubing supported by a wellhead of a cased well bore, the upper valve housing having an upper valve seat and an upper valve for controlling a flow of produced fluids through the subsurface lift engine during a down-stroke thereof; an upper crossover sleeve connected to a bottom end of the upper valve housing; an upper transition sleeve connected to a bottom end of the upper crossover sleeve, the upper transition sleeve having a bottom end connected to the at least one lift engine module, and further having an upper crossover tube that is connected to a bottom end of an upper transition travel limiter that reciprocates within the upper transition sleeve, the upper crossover tube extending through a central passage in a bottom of the upper transition sleeve; and a lower crossover sleeve having a lower valve housing with a lower valve seat and a lower valve for controlling a flow of produced fluid hydrocarbons through the subsurface lift engine during an up-stroke thereof, the lower crossover sleeve being adapted to connect to a production packer that isolates the subsurface lift engine from an annulus of the cased well bore below it, the production packer supporting a production tubing that extends downwardly through the cased hydrocarbon well to fluids in the cased well bore.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1A:
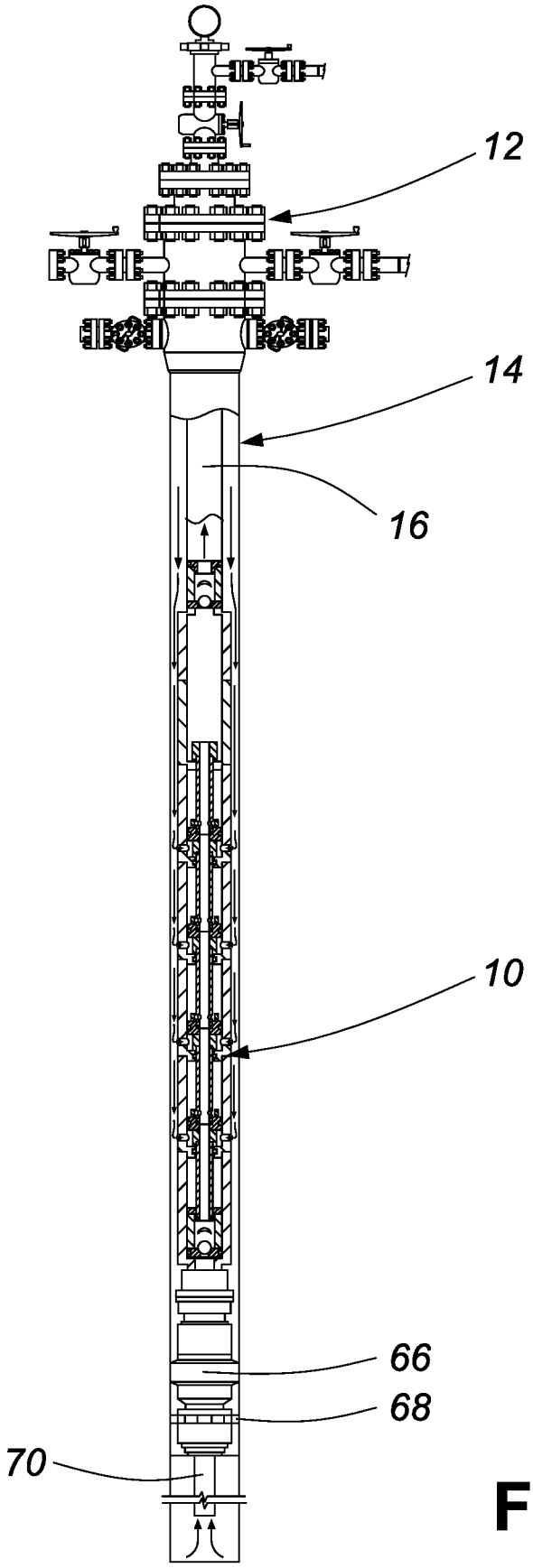
FIG. 1*a* is a cross-sectional view of an embodiment of a modular subsurface lift engine in accordance with the invention configured to directly produce fluids from a cased well bore, shown in an installed condition in the cased wellbore equipped with a production wellhead.

The invention provides a modular subsurface lift engine adapted to directly or indirectly produce fluids from a cased wellbore. Subsurface lift engine modules are respectively connected end-to-end to provide a lift capacity required to lift the fluids from the cased wellbore. The number of lift engine modules required for a particular installation depends on any one or more of several factors. In the case of directly lifting the fluid from the wellbore, those factors may include: a viscosity of the fluids; a vertical lift requirement; a diameter of the wellbore production casing; a diameter of the wellbore production tubing; and, a desired rate of production. In the case of indirectly lifting the fluids from the cased wellbore, the subsurface lift engine may be connected to a downhole reciprocal pump, such as a tubing pump or an insert pump, using a subsurface sucker rod string and the factors determining the number of lift engine modules may include: a viscosity of the fluids; a vertical lift requirement; a diameter of the wellbore production casing; a diameter of the wellbore production tubing; a desired rate of production; a weight of the sucker rod string; and, power requirements of the driven pump.

In the embodiment of the modular lift engine used to directly lift liquid hydrocarbons from a wellbore, an upper valve housing connects the interconnected lift engine modules to a production tubing joint suspended from a production wellhead. An upper valve is housed in the upper valve housing. The upper valve may be any one of a ball valve, a check valve or a flapper valve. The upper valve prevents the backflow of lifted fluids during a downstroke of the lift engine. The upper valve housing is mounted to a top of an upper crossover sleeve. In one embodiment the upper crossover sleeve is elongated and a downstroke spring is inserted between a top end of the upper crossover sleeve and an upper transition travel limiter. The downstroke spring constantly urges the modular subsurface lift engine to a bottom-of-stroke condition to provide a positive downstroke when the modular subsurface lift engine is installed in a highly deviated wellbore, a horizontal wellbore, is used to produce very viscous fluid, or is used to provide a very long vertical lift. An upper transition sleeve connected to a bottom of the upper crossover sleeve supports the interconnected lift engine modules.

A lower crossover sleeve connects the interconnected lift engine modules to a production packer that isolates the modular subsurface lift engine from the cased wellbore below the production packer. A production tubing string is connected to a lower end of the production packer. The production tubing string extends down through the cased wellbore to the fluids to be produced from the cased well bore.

Each lift engine module includes a modular cylinder sleeve having an open top end and a modular cylinder sleeve bottom wall that connects the modular cylinder sleeve to a lift engine module below it. Each modular cylinder sleeve bottom wall has a central opening that accommodates a modular cylinder tube. A lower end of each modular cylinder sleeve includes at least two modular cylinder sleeve ports that provide fluid communication between an annulus of the cased well bore and a lift chamber of the modular cylinder sleeve. Each modular cylinder sleeve houses a modular cylinder piston having a piston seal that provides a high pressure fluid seal between the modular cylinder piston and an inner wall of the modular cylinder sleeve. Each modular cylinder piston has a top travel limiter that limits piston travel during an up-stroke of the subsurface lift engine. Each modular cylinder piston also has a bottom travel limiter that limits the piston travel during a down-stroke of the cylinder piston. The bottom travel limiter prevents the cylinder piston from occluding the modular cylinder sleeve ports at the bottom of a down-stroke of the subsurface lift engine. A modular cylinder tube is threadedly connected to a lower end of each piston lower travel limiter and a top end of a piston upper travel limiter of an adjacent lower module. The modular cylinder tubes provide an uninterrupted fluid path through the interconnected cylinder modules. Each modular cylinder tube has at least two modular cylinder tube ports that provide fluid communication with a modular cylinder pump chamber above the modular cylinder piston of each subsurface lift engine module. The piston upper travel limiters prevent the modular cylinder tube ports from reaching a high-pressure fluid seal in the bottom wall of an adjacent lift engine module above it.

The lower crossover sleeve includes a lower valve housing with a lower valve seat and a lower valve that controls fluid flow through the subsurface lift engine modules during an up-stroke of the subsurface lift engine. The lower valve may be any one of a ball valve, a check valve or a flapper valve.

The subsurface lift engine is driven by surface equipment assembled using components well known in the art. In one embodiment a high-pressure fluid pump pumps a lift fluid from a lift fluid reservoir. The lift fluid may be any stable, non-corrosive fluid such as, for example, corrosion inhibited water or a light oil such as diesel fuel, kerosene, hydraulic fluid, or the like. Lift fluid is supplied to the high-pressure pump through a lift fluid supply line. Lift fluid exits the high-pressure fluid pump via a pump pressure line to a pump pressure valve, for example a solenoid-controlled valve, that selectively routes the lift fluid thorough the lift fluid pressure line to the annulus of the hydrocarbon well isolated by the production packer, or to a lift fluid pressure bypass line connected to the lift fluid reservoir. The annulus of the hydrocarbon well is also connected to a lift fluid dump line, which is in turn connected to the lift fluid reservoir. A dump fluid valve controls flow through the lift fluid dump line.

In operation, the high-pressure pump continuously pumps the lift fluid at a predetermined pump rate. During an upstroke of the subsurface lift engine, the solenoid-controlled valve in the lift fluid pressure line is open and the lift fluid dump valve in the lift fluid dump line is closed. The lift fluid therefore flows into the isolated annulus of the hydrocarbon well and through the modular cylinder sleeve ports into the respective modular cylinder lift chambers, urging the respective modular cylinder pistons upwardly. The upward movement of the modular cylinder pistons forces produced fluid out of the modular cylinder produced fluid chambers through the modular cylinder tube ports, up through the respective modular cylinder tubes to the production tubing in the wellhead, and out through a hydrocarbon production pipe to a hydrocarbon production reservoir, which may be a tank, a pipeline, or the like. When the modular cylinder piston upper travel limiters contact the modular cylinder bottom wall of an adjacent lift engine module, a pressure spike occurs in the lift fluid. The pressure spike is sensed by a pressure sensor that trips the lift fluid dump valve to open the lift fluid dump line and simultaneously trips the pump pressure line control valve to shift to reroute the lift fluid through the lift fluid bypass line to the lift fluid reservoir. These valve movements drain lift fluid pressure from the subsurface lift engine and the annulus of the wellbore, and the subsurface lift engine down-strokes under its own weight and, in one embodiment, the pressure of the downstroke spring. The down-stroke closes the upper valve and opens the lower valve as the modular cylinder pistons downward movements create suction in the respective modular cylinder produced fluid chambers, which sucks produced fluid up into the respective modular cylinder produced fluid chambers. When the pressure sensor senses an absence of fluid pressure in the dump fluid line, the lift fluid dump valve is closed and the lift fluid bypass valve is shifted to reroute the lift fluid from the lift fluid bypass line to the lift fluid pressure line and another up-stroke commences. During the up-stroke, the subsurface lift engine lower valve is closed and the subsurface lift engine upper valve opens as the produced fluids flow from the modular cylinder produced fluid chambers to the hydrocarbon reservoir, as described above.

| Part No. | Part Desc1ription |
|---|---|
| 10 | Modular subsurface lift engine |
| 10a | Subsurface lift engine (indirect production configuration) |
| 10b | Subsurface lift engine (downstroke spring assist) |
| 12 | Wellhead |
| 14 | Production casing |
| 16 | Production tubing pup joint |
| 18 | Upper crossover sleeve |
| 18b | Elongated upper crossover sleeve |
| 20 | Upper transition sleeve |
| 21 | Upper transition travel limiter |
| 22 | Upper valve housing |
| 23 | Upper crossover tube |
| 24 | Upper valve seat |
| 26 | Upper transition sleeve cap |
| 28 | Upper valve fluid seal |
| 30 | Upper ball valve |
| 31 | Upper valve limiter |
| 32a-32d | Subsurface lift engine modules |
| 34a-34d | Modular cylinder sleeves |
| 35a-35d | Modular cylinder sleeve bottom walls |
| 36a-36h | Modular cylinder sleeve ports |
| 37a-37d | Modular cylinder sleeve bottom wall passage |
| 38a-38d | Modular cylinder pistons |
| 39a-39d | Modular cylinder sleeve inner walls |
| 40a-40d | Modular cylinder piston seals |
| 42a-42d | Piston upper travel limiters |
| 44a-44d | Piston lower travel limiters |
| 45a-45d | Modular cylinder lift chambers |
| 46b-46d | Modular cylinder tubes |
| 48c-48h | Modular cylinder tube ports |
| 49b-49d | Modular cylinder produced fluid chambers |
| 50a-50d | Modular cylinder tube upper seals |
| 52a-52d | Modular cylinder tube lower seals |
| 54 | Lower crossover sleeve |
| 55 | Lower crossover tube |
| 55a | Lower crossover tube (indirect production configuration) |
| 56 | Lower valve housing |
| 58 | Lower valve seat |
| 60 | Lower valve seal cap |
| 62 | Lower valve fluid seal |
| 64 | Lower ball valve |
| 65 | Lower valve limiter |
| 66 | Production packer |
| 68 | Production packer slips |
| 70 | Production tubing string |
| 72 | Sucker rod string |
| 74 | Downhole pump |
| 75a, 75a | Lower crossover tube ports |
| 76 | Lower crossover tube thread |
| 100 | Surface equipment |
| 102 | Fluid pump |
| 104 | Lift fluid reservoir |
| 106 | Lift fluid supply line |
| 108a-b | Lift fluid pressure line |
| 110 | Pump pressure line control valve |
| 112 | Lift fluid bypass line |
| 114a-b | Lift fluid dump line |
| 116 | Lift fluid dump valve |
| 117 | Lift fluid pressure sensor |
| 118 | Solenoid control circuit |
| 120 | Hydrocarbon production pipe |
| 122 | Hydrocarbon reservoir |
| 124 | Lift fluid |
| 126 | Produced fluid |
| 128 | Isolated well bore annulus |
| 130 | Downstroke spring |

FIG. 1*a* is a cross-sectional view of one embodiment of a modular subsurface lift engine 10 in accordance with the invention, configured to directly produce hydrocarbons from a cased well bore 14. The modular subsurface lift engine 10 is shown in an installed condition in the production casing 14 of a cased well bore, which is equipped with a production wellhead 12. Surface components of the cased well bore, such as the conductor, etc. are not shown. A top end of the modular subsurface lift engine 10 is connected to the wellhead 12 by a production tubing "pup joint" 16 in a manner well known in the art. A bottom end of the modular subsurface lift engine 10 is connected to a production packer 66, which is well known in the art. The production packer 66 provides a high-pressure fluid seal to isolate an annulus of the production casing 14 around the modular subsurface lift engine 10 from an annulus of the production casing 14 below the production packer 14, the purpose of which will be explained in detail below with reference to FIGS. 1*b* and 2. The production packer 66 is supported in the production casing 14 by production packer slips 68, in a manner also well understood in the art. A production tubing string 70, which extends down to a production zone of the cased well bore, is connected to a downhole end of the production packer 66.

Figure 1B:
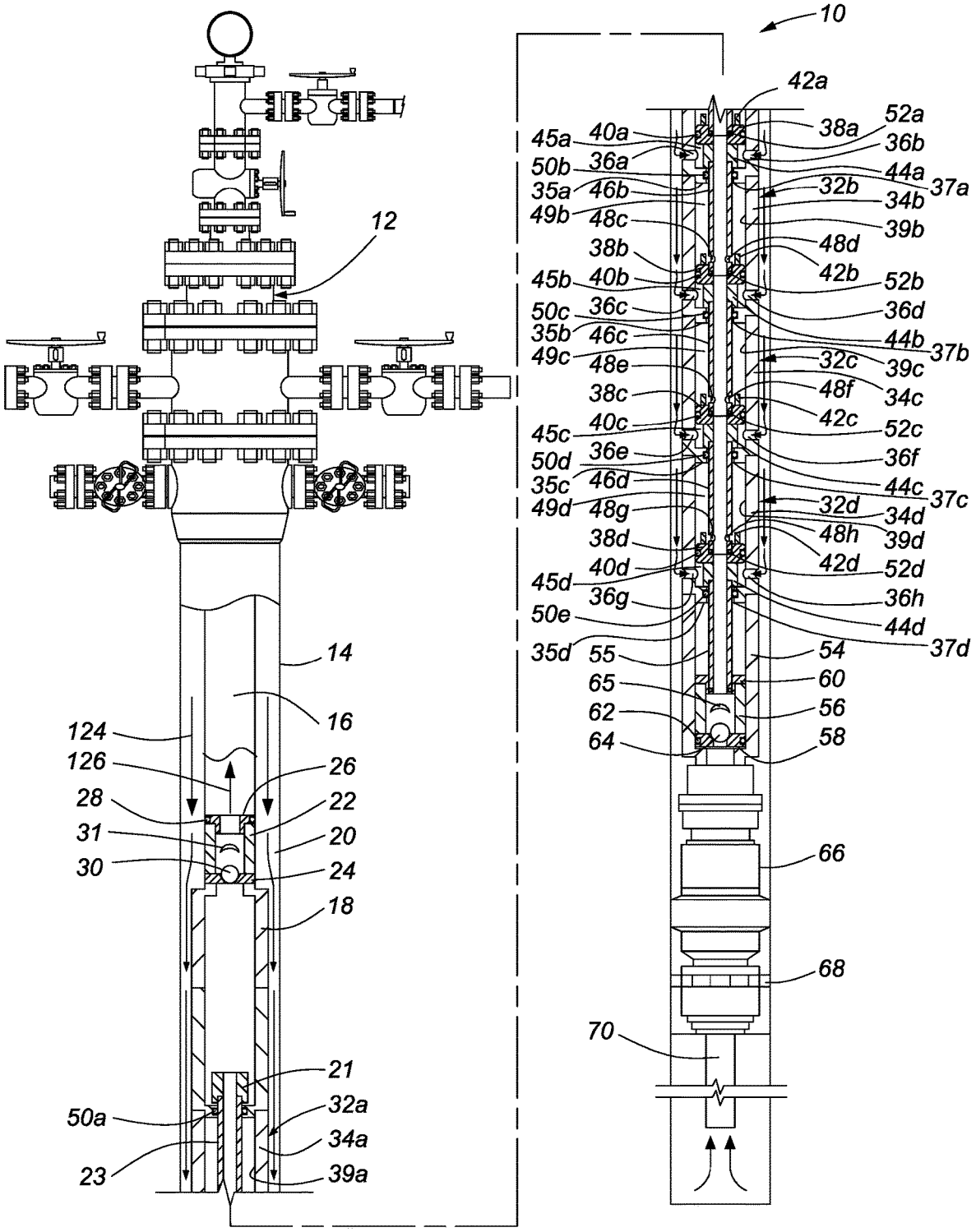
FIG. 1*b* is the cross-sectional view of the embodiment of the modular subsurface lift engine shown in FIG. 1*a*, enlarged to more clearly illustrate the elements of the subsurface lift engine.

FIG. 1*b* is the cross-sectional view of the embodiment of the modular subsurface lift engine 10 shown in FIG. 1*a*, enlarged to more clearly illustrate the elements of the modular subsurface lift engine 10. The modular subsurface lift engine 10 includes an upper valve housing 22 connected to the production tubing pup joint 16. An upper valve seat 24 is connected to a bottom end of the upper valve housing 22. An upper valve housing cap 26 is connected to a top end of the upper valve housing 22. The upper valve housing cap 26 supports an upper valve fluid seal 28, which provides a high-pressure fluid seal between the production tubing pup joint 16 and the upper valve housing 22. The upper valve seat 24 supports an upper valve, which in this embodiment is an upper ball valve 30, although the upper valve may be a flapper valve or a check valve, both of which are well known in the art. Upward travel of the upper ball valve 30 is restrained by an upper valve limiter 31, which is only required when the upper valve is the upper ball valve 30. A bottom end of the upper valve housing 22 is connected to an upper crossover sleeve 18. An upper transition sleeve 20 is connected to a bottom end of the upper crossover sleeve 18. The upper transition sleeve 20 receives an upper transition travel limiter 21 connected to an upper crossover tube 23.

Connected to a bottom end of the upper transition sleeve 20 is a first subsurface lift engine module 32*a*. Each subsurface lift engine module 32*a*-32*d* includes a modular cylinder sleeve 34*a*-34*d*, which has a modular cylinder sleeve bottom wall 35*a*-35*d*. Just above the modular cylinder sleeve bottom wall are a plurality of modular cylinder sleeve ports 36*a*-36*h*, only two of which are shown in each modular cylinder sleeve 34*a*-34*d*. The function of the modular cylinder sleeve ports 36*a*-36*h* be explained below with reference to FIGS. 2-4*b*. Each modular cylinder sleeve bottom wall 35*a*-35*d* also includes a modular cylinder sleeve bottom wall passage 37*a*-37*d* that accommodates a modular cylinder tube 46*b*-46*d*, as will be explained below in more detail. A modular cylinder piston 38*a*-38*d* reciprocates within each modular cylinder sleeve 34*a*-34*d*. A modular cylinder piston seal 40*a*-40*d* provides a high-pressure fluid seal between respective modular cylinder sleeve inner walls 39*a*-39*d* of the respective modular cylinder sleeves 34*a*-34*d* and the respective modular cylinder pistons 38*a*-38*d*. Each modular cylinder piston 38*a*-38*d* includes piston upper travel limiters 42*a*-42*d* which limits upward travel of the respective modular cylinder pistons 38*a*-38*d* in the respective modular cylinder sleeves 34*a*-34*d* to prevent an occlusion of modular cylinder tube ports 48*c*-48*h* in the respective modular cylinder tubes 46*b*-46*d*. Each modular piston 38*a*-38*d* also includes piston lower travel limiters 44*a*-44*d*. The piston lower travel limiters 44*a*-44*d* limit downward travel of the respective modular cylinder pistons 38*a*-38*d* in the respective modular cylinder sleeves 32*a*-32*d* to prevent an occlusion by the respective modular cylinder pistons 38*a*-38*d* of modular cylinder sleeve ports 36*a*-36*h* in the respective modular cylinder sleeves 34*a*-34*d*. Each modular cylinder piston 38*a*-38*d* divides an interior of the respective modular cylinder sleeves 34*a*-34*d* into a modular cylinder lift chamber 45*a*-45*d* and a modular cylinder produced fluid chamber 49*a*-49*d*, the respective functions of which will be explained below in detail.

A respective modular cylinder tube 46*b*-46*d* interconnects a respective piston lower travel limiter 44*a*-44*d* to a respective piston upper travel limiter 42*a*-42*d*. A respective modular cylinder tube upper seal 50*a*-50*e* provides a high-pressure fluid seal around a top end of the respective modular cylinder tubes 46*a*-46*d* where they pass through the respective modular cylinder sleeve bottom walls 35*a*-35*d*. A respective modular cylinder tube lower seal 52*a*-52*d* provides a high-pressure fluid seal around a bottom end of the respective modular cylinder tubes 46*a*-46*d* where they connect to the respective modular cylinder pistons 38*a*-38*d*.

A lower crossover sleeve 54 is connected to a lowest subsurface lift engine module, 32*d* in this example. A bottom end of the lower crossover sleeve 54 is connected to the production packer 66. The lower crossover sleeve 54 houses a lower valve housing 56, which reciprocates within the lower crossover sleeve 54. The lower valve housing 56 has a lower valve seat 58 and a lower valve seat seal cap 60. The lower valve seat cap 60 is connected to a lower crossover tube 55 having a top end connected to the piston lower travel limiter 44*d*. The lower valve seat 58 supports a lower valve fluid seal 62 that provides a high-pressure fluid seal between the lower valve housing 56 and the lower crossover sleeve 54. A lower valve, in this example lower ball valve 64 is received in the lower valve seat 58. A lower valve limiter 65 limits an upward travel of the lower ball valve 64 during a downstroke of the modular lift engine 10.

Figure 2:
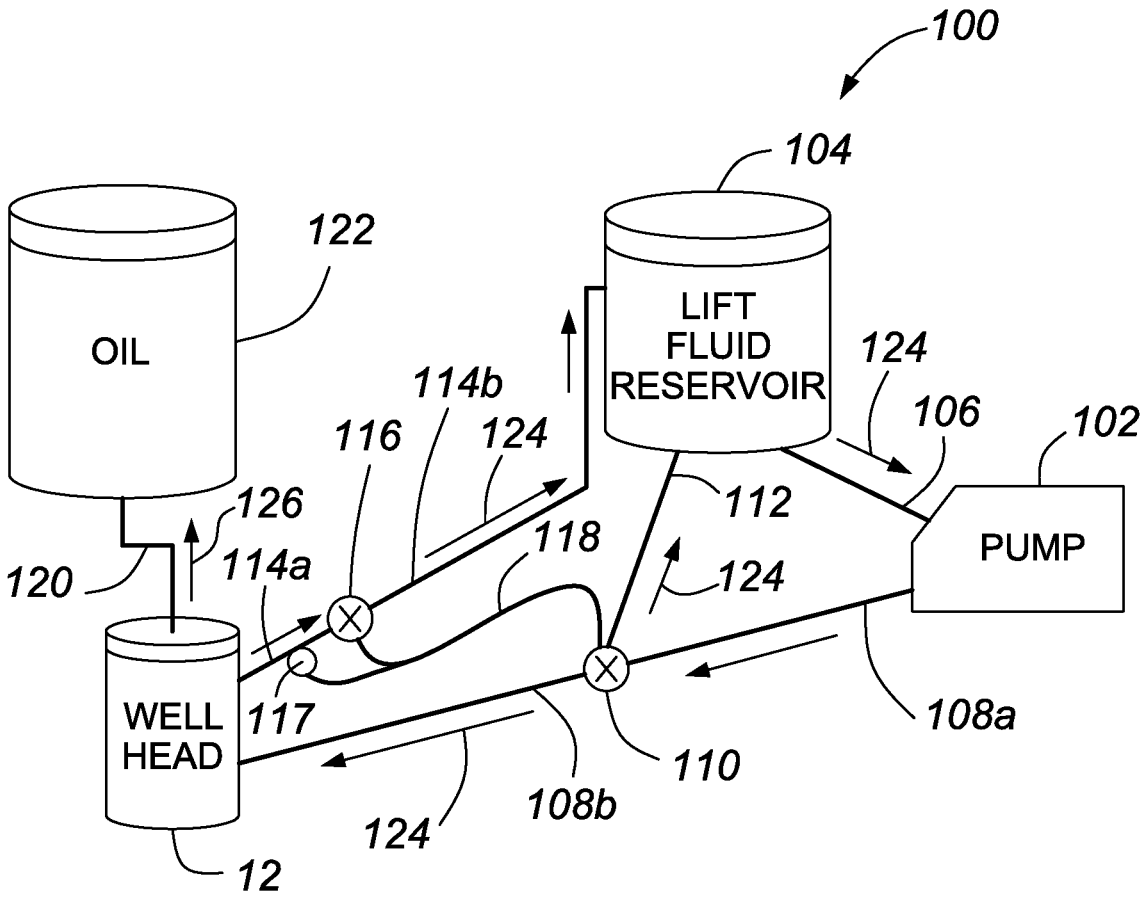
FIG. 2 is a schematic view of one embodiment of surface equipment used to drive the modular subsurface lift engine shown in FIGS. 1*a* and 1*b* and 5.

FIG. 2 is a schematic view of one embodiment of surface equipment 100 used to power the modular subsurface lift engine 10 shown in FIGS. 1*a* and 1*b*. In this embodiment, the surface equipment 100 includes a high-pressure fluid pump 102, the specifications of which are readily computed by one skilled in the art of hydraulics. Lift fluid 124 is stored in a lift fluid reservoir 104, the capacity of which is dependent on a diameter of an annulus of the production casing 14 and a number of subsurface lift engine modules 32 in the modular subsurface lift engine 10, as will be readily understood by those skilled in the art. A lift fluid supply line 106 supplies lift fluid 124 from the lift fluid reservoir 104 to the fluid pump 102. The lift fluid selected depends on an operating environment in which the modular lift engine is used. A light hydrocarbon, such as kerosene or diesel fuel, is acceptable in most environments, though corrosion and, if necessary, frost-inhibited, water may also be used. A lift fluid pressure line 108*a* connects an output of the fluid pump 102 to a pump pressure line control valve 110 that in one embodiment is operated by a solenoid that switches fluid flow through the lift fluid pressure line 108*a* to one of a lift fluid pressure line 108*b* and a lift fluid bypass line 112. As explained above, during an upstroke of the modular subsurface lift engine 10, the lift fluid flows into the annulus of the cased well bore 14. In one embodiment, at the top of stroke, a pressure spike in the lift fluid is detected by a lift fluid pressure sensor 117 connected to a solenoid control circuit 118, which switches the pump pressure line control valve 110 to bypass mode so the lift fluid 124 is diverted through a lift fluid bypass line 112. The lift fluid 124 is thus returned to the lift fluid reservoir 104. In one embodiment a solenoid control circuit 118 interconnects the pump pressure line control valve 110 and a lift fluid dump valve 116, which in one embodiment is also controlled by a solenoid. When the pump pressure line control valve 110 switches to the bypass mode, a signal sent through the solenoid control circuit 116 to the lift fluid dump valve 116 opens the lift fluid dump valve 116 and allows lift fluid 124 to flow from the annulus of the production casing 14 of the cased well bore to the lift fluid reservoir 104 through lift fluid dump lines 114*a*, 114*b*. As lift fluid 124 is dumped from the modular subsurface lift engine 10 it begins a downstroke under its own weight. At the bottom of the downstroke, fluid flow through the lift fluid dump lines 114*a*, 114*b* stops and pressure in the lift fluid dump lines 114*a*, 114*b* drops. The pressure drop is sensed by the lift fluid pressure sensor 117 which sends a signal through the solenoid control circuit 118 that causes the lift fluid dump valve 116 to close and the pump pressure line control valve 110 to switch lift fluid flow from the lift fluid bypass line 112 to the lift fluid pressure line 108*b*. This starts the modular subsurface lift engine on another upstroke, lifting hydrocarbon through a hydrocarbon production pipe 120 to a hydrocarbon reservoir 122, which may be a tank, a pipeline, or the like.

Figure 3A:
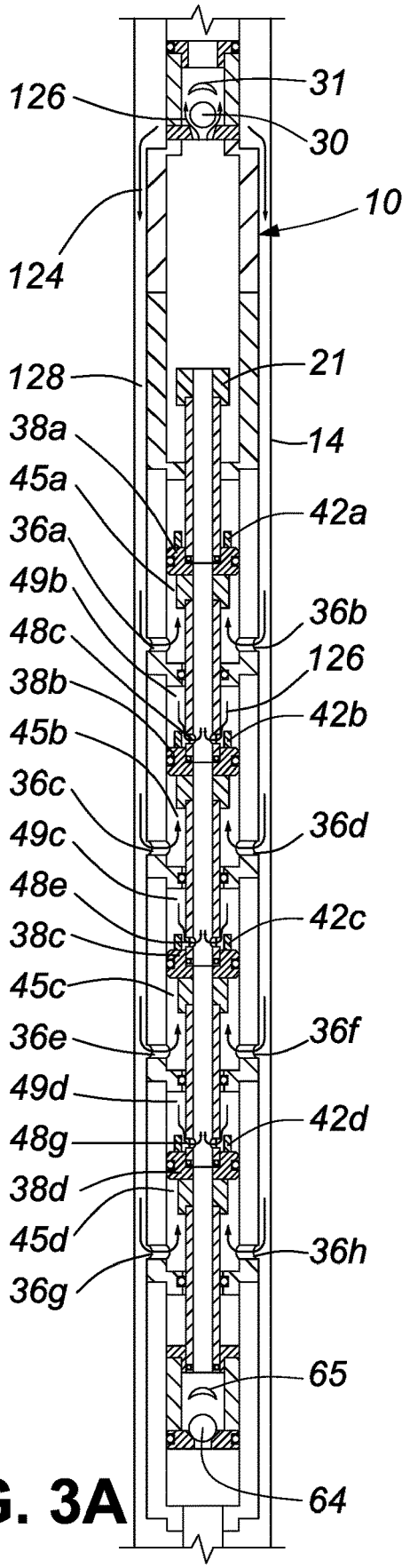
FIG. 3*a* is a cross-sectional view of the modular subsurface lift engine shown in FIGS. 1*a* and 1*b* in an up-stroke condition.

FIG. 3*a* is a cross-sectional view of an embodiment of the modular subsurface lift engine 10 shown in FIGS. 1*a* and 1*b* in an up-stroke condition. As explained above, during an upstroke the lift fluid 124 is being pumped into the isolated annulus 128 of the production casing 14 and is forced through the modular cylinder sleeve ports 36*a*-36*f* into the respective cylinder lift chambers 45*a*-45*d*, which urges the respective modular cylinder pistons 38*a*-38*d* upwardly. The upward movement of the modular cylinder pistons 45*a*-45*d* urges produced fluid 126 out of the respective modular cylinder produced fluid chambers 49*a*-49*d* and into the modular cylinder tubes 46*b*-46*d*. Initiation of the up-stroke closes the lower ball valve 64 and opens the upper ball valve 30, pumping fluid through the wellhead 12 and into the hydrocarbon production pipe 120. When the modular subsurface lift engine reaches top of stroke, the piston upper travel limiters 42*a*-42*d* contact a respective modular cylinder sleeve bottom wall 35*a*-35*d*, which halts further movement of the modular cylinder pistons 45*a*-45*d*, causing a pressure spike in the lift fluid 124, as described above with reference to FIG. 2.

Figure 3B:
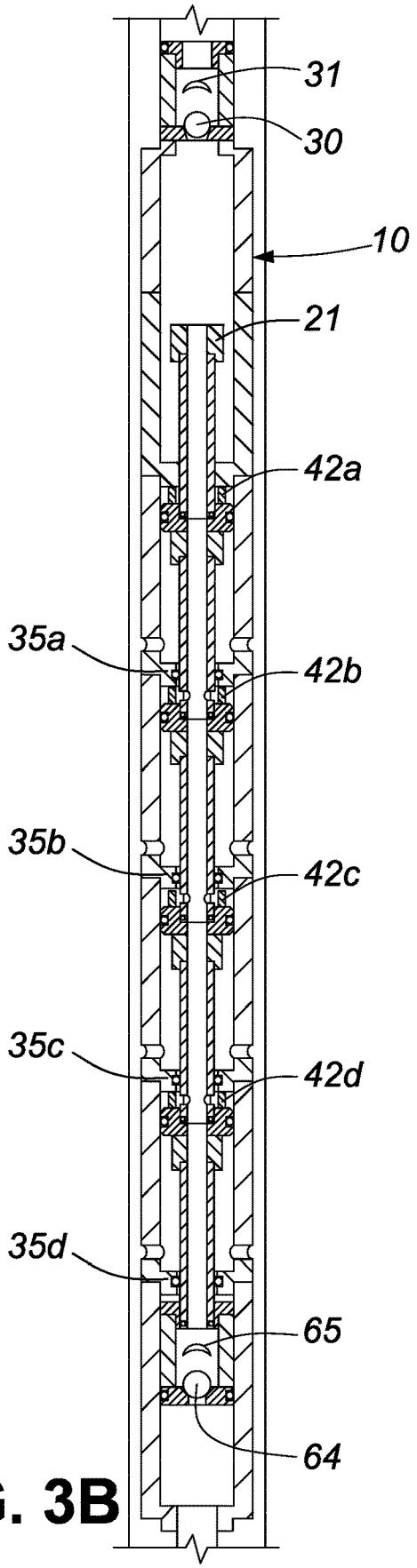
FIG. 3*b* is a cross-sectional view of the modular subsurface lift engine shown in FIGS. 1*a* and 1*b* in a top-of-stroke condition.

FIG. 3*b* is a cross-sectional view of the modular subsurface lift engine 10 shown in FIGS. 1*a* and 1*b* in a top-of-stroke condition. In this condition, the upper ball valve 30 and the lower ball valve 60 both rest on their respective valve seats.

Figure 4A:
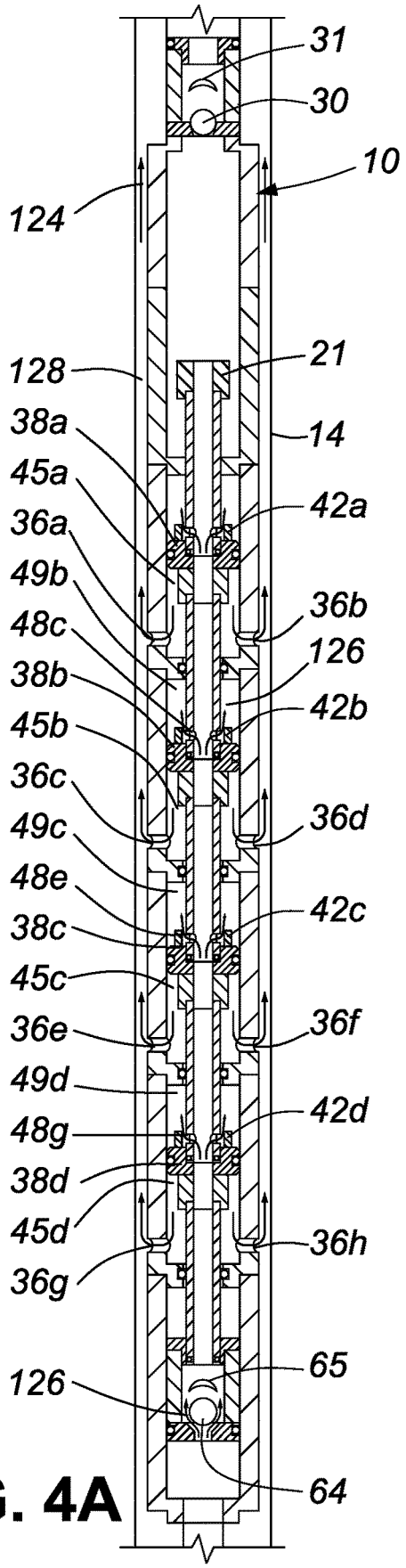
FIG. 4*a* is a cross-sectional view of the modular subsurface lift engine shown in FIGS. 1*a* and 1*b* in a down-stroke condition.

FIG. 4*a* is a cross-sectional view of the modular subsurface lift engine 10 shown in FIGS. 1*a* and 1*b* in a downstroke condition. When, as described above with reference to FIG. 2, the pump pressure line control valve 110 diverts lift fluid from the lift fluid pressure line 108*a* to the lift fluid bypass line 112, lift fluid 124 stops flowing into the isolated annulus 128 of the production casing 14 and the weight of the moveable parts of the modular subsurface lift engine 10 returns those parts to a bottom-of-stroke condition. This creates fluid pressure in the respective modular cylinder lift chambers 45*a*-45*d*, forcing lift fluid 124 out of those modular cylinder lift chambers 45*a*-45*d*, into the isolated annulus 128 and up through the lift fluid dump lines 114*a* and 114*b* to the lift fluid reservoir 104 (see FIG. 2). It also creates suction in the respective modular cylinder produced fluid chambers 49*b*-49*d*, which draws produced fluid 126 up into those chambers from the production tubing string 70. The lower ball valve 64 remains open until the respective modular cylinder produced fluid chambers 49*b*-49*d* are full and the modular subsurface lift engine is at bottom stroke, where the respective piston lower travel limiters 44*a*-44*d* contact the respective modular cylinder sleeve bottom walls 35*a*, 35*d*.

Figure 4B:
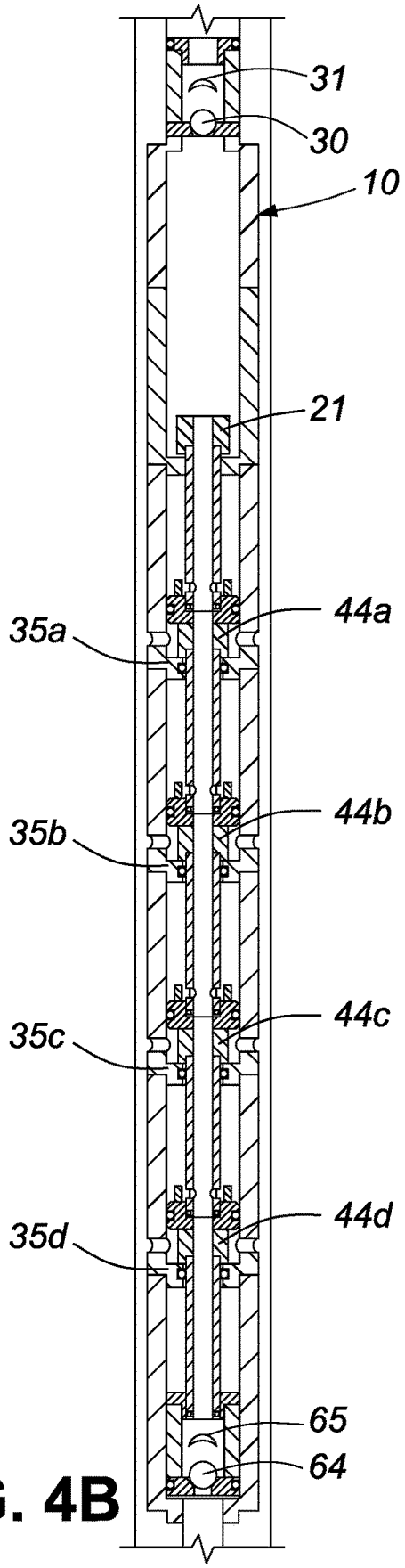
FIG. 4*b* is a cross-sectional view of the modular subsurface lift engine shown in FIGS. 1*a* and 1*b* in a bottom-of-stroke condition.

FIG. 4*b* is a cross-sectional view of the modular subsurface lift engine 10 shown in FIGS. 1*a* and 1*b* in a bottom-of-stroke condition. In this condition, the upper ball valve 30 and the lower ball valve 60 both rest on their respective valve seats.

Figure 5:
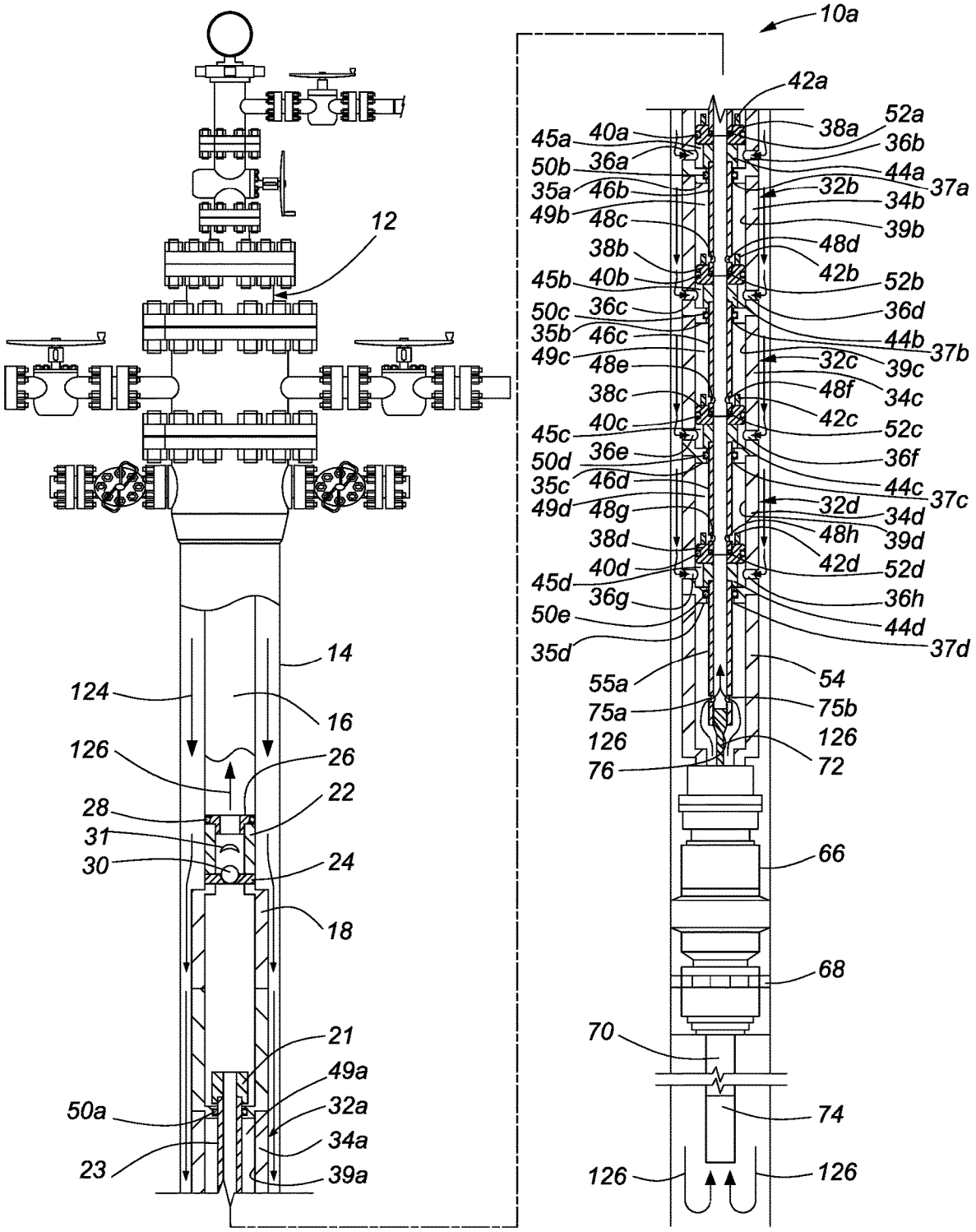
FIG. 5 is a cross-sectional view of one embodiment of a modular subsurface lift engine configured to indirectly produce hydrocarbons from a cased well bore.

FIG. 5 is a cross-sectional view of one embodiment of a modular subsurface lift engine 10*a* configured to indirectly produce hydrocarbons from a cased well bore. In this configuration, the modular subsurface lift engine 10*a* is as described above with reference to FIG. 1*b*, except that the lower valve housing 56 (see FIG. 1*b*), and all components within it, is removed from the lower crossover sleeve 54, and the lower crossover tube 55*a* is provided with lower crossover tube ports 75*a*, 75*b* and internal tread 76 for the connection of a top end of a sucker rod string 72. The sucker rod string 72 extends down through the production packer and the production tubing string 70 and is operatively connected a downhole pump 74 for lifting the produced fluid 126 from the cased well bore. The downhole pump 74 may be a sucker rod pump, which connect to a bottom end of a production tubing string 70, or an insert pump secured within a bottom end of the production tubing string 70. The downhole pump is selected to have a stroke length equal to a travel of the subsurface lift engine 10*a* from bottom-of-stroke to top-of-stroke.

In use, the modular subsurface lift engine 10*a* operates as described above with reference to FIG. 2. As understood by those skilled in the art, the number of subsurface lift engine modules 32 selected for the subsurface lift engine 10*a* is dependent on an output of the fluid pump 102, a weight of the sucker rod string 72, and power requirements of the downhole pump 74.

Figure 6:
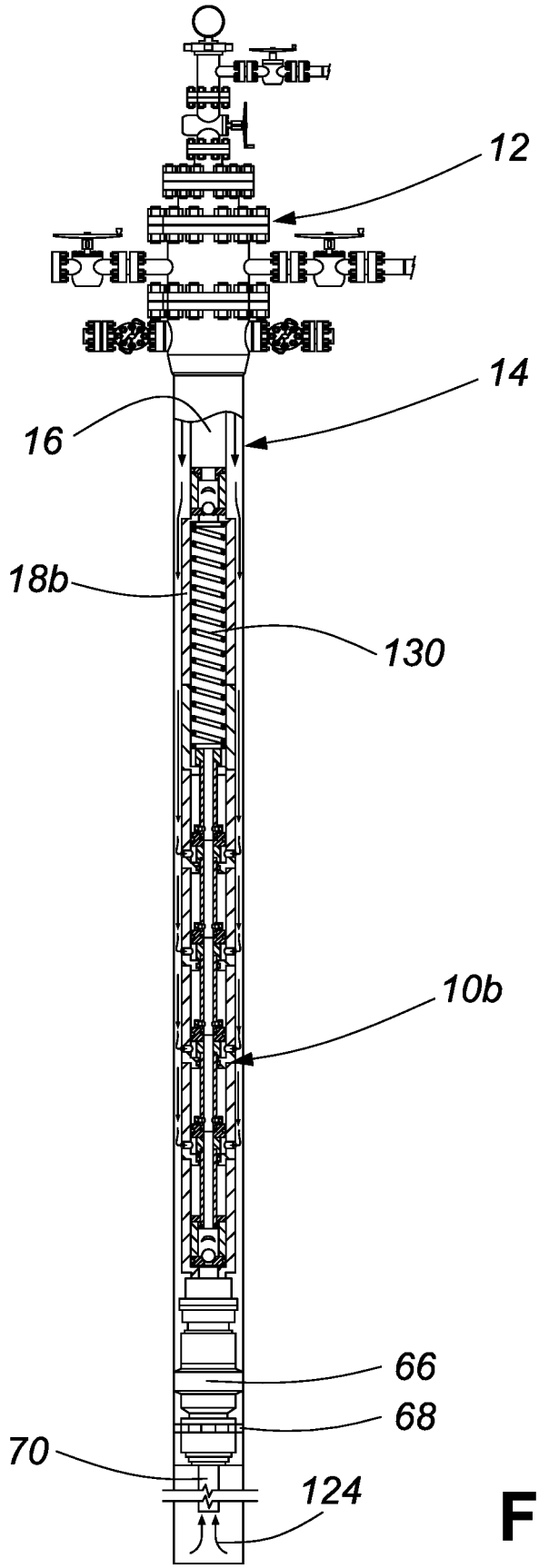
FIG. 6 is a cross-sectional view of another embodiment of the modular subsurface lift engine in accordance with the invention configured to directly produce fluids from a cased well bore, shown in an installed condition in the cased wellbore equipped with a production wellhead.

FIG. 6 is a cross-sectional view of another embodiment of the modular subsurface lift engine 10*b* in accordance with the invention configured to directly produce fluids from a cased well bore, shown in an installed condition in the cased wellbore equipped with a production wellhead 12. The subsurface lift engine 10*b* is identical to the subsurface lift engine described above with reference to FIGS. 1A and 18, except that the upper crossover sleeve 18 is replaced with an elongated upper crossover sleeve 18*b*, which accommodates a downstroke spring 130 that provides downstroke assist to the modular subsurface lift engine 10*b*. The downstroke spring 130 constantly urges the modular subsurface lift engine 10*b* to the bottom-of-stroke condition. The compression force of the downstroke spring 130 is selected to provide a predetermined downstroke return force in the modular subsurface lift engine that is dependent on factors such as a viscosity of the produced fluid 126, a height of lift required to produce fluid 126, etc. The modular subsurface lift engine 10*b* is also ideally suited for installation in a highly deviated or a horizontal well bore, as will be explained below with reference to FIG. 7.

Figure 7:
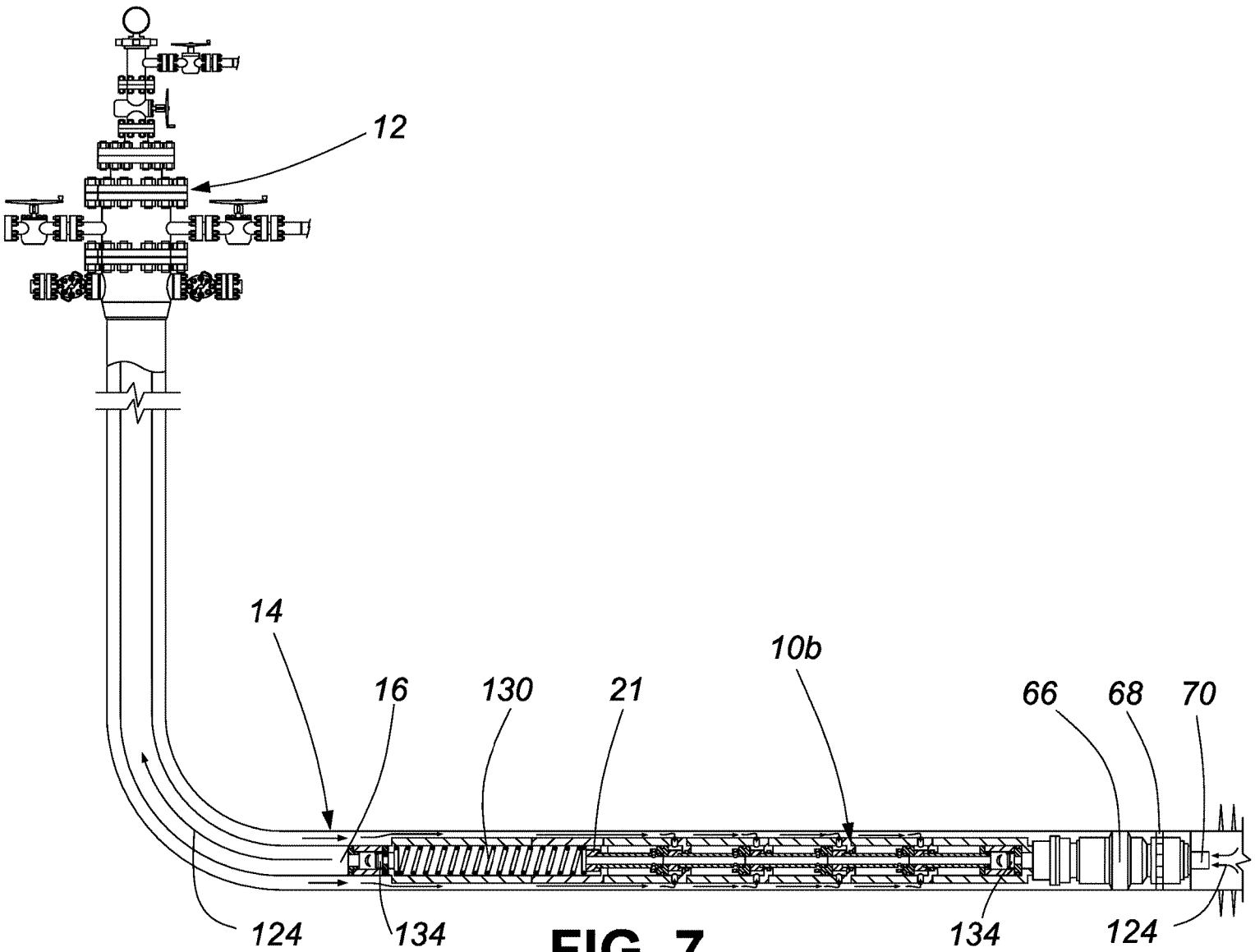
FIG. 7 is a cross-sectional view of the embodiment of the modular subsurface lift engine installed in a horizontal wellbore.

FIG. 7 is a cross-sectional view of the embodiment of the modular subsurface lift engine 10*b* installed in a horizontal wellbore with a production casing 14. Since the downstroke force for the modular subsurface lift engine 10*b* is provided by the downstroke spring 130, the modular subsurface lift engine can be installed within a horizontal wellbore, which ensures maximum production of produced fluid 124. When installed in a highly deviated or horizontal well bore, the upper and lower ball valves are also replaced with spring-biased flapper valves 132 to ensure valve operation in any orientation.

The explicit embodiments of the invention described above have been presented by way of example only. The scope of the invention is therefore intended to be limited solely by the scope of the appended claims.

I claim:

1. A modular subsurface lift engine, comprising:

an upper valve housing with an upper valve seat and an upper valve for controlling a flow of produced fluid hydrocarbons through the subsurface lift engine during a down-stroke thereof;

an upper crossover sleeve connected to a bottom end of the upper valve housing;

an upper transition sleeve connected to a bottom end of the upper crossover sleeve;

an upper crossover tube connected to an upper travel limiter that reciprocates within the upper transition sleeve, the upper crossover tube extending through a central passage in a bottom of the upper transition sleeve;

at least one subsurface lift engine module connected to a bottom end of the upper transition sleeve, respectively comprising a modular cylinder sleeve, a modular cylinder piston that reciprocates within the modular cylinder sleeve, and a modular cylinder tube connected to a lower side of the modular cylinder piston and extending through a passage in a modular cylinder sleeve bottom wall of the modular cylinder sleeve; and a lower crossover sleeve adapted to connect to a production packer that isolates an annulus of the cased well bore surrounding the modular subsurface lift engine from the annulus of the cased well bore below the production packer.

2. The modular subsurface lift engine as claimed in claim 1 wherein the lower crossover sleeve further comprises a lower valve housing with a lower valve seat and a lower valve for controlling a flow of produced fluids through the subsurface lift engine during an up-stroke thereof.

3. The modular subsurface lift engine as claimed in claim 1 further comprising a sucker rod string connected to a bottom end a of a lower crossover tube of the modular subsurface lift engine, the sucker rod string extending through the production packer and connecting to a downhole fluid pump.

4. The modular subsurface lift engine as claimed in claim 1 wherein the upper valve housing is adapted to connect to a production tubing supported by a wellhead of the cased well bore.

5. The modular subsurface lift engine as claimed in claim 1 wherein each modular cylinder sleeve comprises modular cylinder sleeve ports through a sidewall thereof, the modular cylinder sleeve ports being adjacent the modular cylinder sleeve bottom wall and modular cylinder tube ports adjacent a bottom end of the respective modular cylinder tubes.

6. The modular subsurface lift engine as claimed in claim 1 wherein the upper valve and the lower valve respectively comprise a ball valve and an upper valve limiter in the upper valve housing and a ball valve and lower valve limiter in the lower valve housing.

7. The modular subsurface lift engine as claimed in claim 5 further comprising a piston upper travel limiter on an upper side of the respective modular cylinder pistons to limit an upward travel of the respective modular cylinder pistons in the respective modular cylinder sleeves and a piston lower travel limiter on a lower side of the respective modular cylinder pistons to limit a downward travel of the respective modular cylinder pistons in the respective modular cylinder sleeves.

8. The modular subsurface lift engine as claimed in claim 4 wherein the upper crossover sleeve is elongated and houses a downstroke spring that constantly urges the modular subsurface lift engine to a bottom-of-stroke condition.

9. The modular subsurface lift engine as claimed in claim 5 further comprising a modular surface lift engine drive system that comprises:

a fluid pump adapted to continuously pump a lift fluid from a lift fluid reservoir at a predetermined rate; and at least two control valves for controlling a flow of the lift fluid so that the lift fluid is supplied from the lift fluid reservoir to the isolated annulus during an upstroke of the modular subsurface lift engine and diverted to the lift fluid reservoir while lift fluid is drained from the isolated annulus to the lift fluid reservoir during a downstroke of the modular subsurface lift engine.

10. The modular subsurface lift engine as claimed in claim 9 wherein the modular subsurface lift engine drive system comprises:

a lift fluid supply line connected between the lift fluid reservoir and an input of the fluid pump to supply the lift fluid to the fluid pump;

a lift fluid pressure line connected to an output of the fluid pump and in fluid communication with the isolated annulus above the production packer;

a first control valve in the lift fluid pressure line adapted to control a flow of lift fluid through the lift fluid pressure line by selectively diverting the lift fluid to a lift fluid bypass line interconnecting the first control valve and the lift fluid reservoir;

a lift fluid dump line providing fluid communication between the isolated annulus and the lift fluid reservoir;

a second control valve in the lift fluid dump line adapted to control lift fluid flow through the lift fluid dump line;

a control circuit for controlling the first and second control valves; and at least one lift fluid pressure sensor connected to the control circuit, the lift fluid pressure sensor sensing a pressure of the lift fluid in the isolated annulus.

11. The modular subsurface lift engine as claimed in claim 10 wherein the first control valve and the second control valve are respectively controlled by solenoids connected to the control circuit.

12. A modular subsurface lift engine, comprising:

an upper valve housing adapted to connect to a production tubing supported by a wellhead of a cased well bore, the upper valve housing having an upper valve seat and an upper valve for controlling a flow of produced fluid through the subsurface lift engine during a down-stroke thereof;

an upper crossover sleeve connected to a bottom end of the upper valve housing;

an upper transition sleeve connected to a bottom end of the upper crossover sleeve, the upper transition sleeve having an upper crossover tube that is connected to a bottom of a transition travel limiter, the crossover sleeve extending through a central passage in a bottom of the upper transition sleeve;

at least one subsurface lift engine module connected to a bottom end of the upper transition sleeve and comprising a modular cylinder sleeve, a modular cylinder piston that reciprocates within the modular cylinder sleeve, and a modular cylinder tube connected to a lower side of the modular cylinder piston and extending through a passage in a modular cylinder sleeve bottom wall of the modular cylinder sleeve; and a lower crossover sleeve having a lower valve housing with a lower valve seat and a lower valve for controlling a flow of produced fluids through the subsurface lift engine during an up-stroke thereof, the lower crossover sleeve being adapted to connect to a production packer that isolates an annulus of the cased well bore surrounding the modular subsurface lift engine from the annulus of the cased well bore below the production packer.

13. The modular subsurface lift engine as claimed in claim 12 wherein each modular cylinder sleeve comprises modular cylinder sleeve ports through a sidewall thereof, the modular cylinder sleeve ports being adjacent the modular cylinder sleeve bottom wall and providing fluid communication between the isolated annulus and a lift chamber within the modular cylinder sleeve.

14. The modular subsurface lift engine as claimed in claim 13 further comprising modular cylinder tube ports adjacent a bottom end of the respective modular cylinder tubes to provide fluid communication between a respective modular cylinder lift chamber of the respective modular cylinder sleeves and an interior of the respective modular cylinder tubes.

15. The modular subsurface lift engine as claimed in claim 12 wherein the upper valve and the lower valve respectively comprise one of a ball valve and a flapper valve.

16. The modular subsurface lift engine as claimed in claim 12 wherein each subsurface lift engine module further comprises a piston upper travel limiter on an upper side of the modular cylinder piston to limit an upward travel of the modular cylinder piston in the modular cylinder sleeve, the piston upper travel limiter being adapted to connect to a modular cylinder tube of another subsurface lift engine module connected to a top end thereof, and a piston lower travel limiter on a lower side of the respective modular cylinder pistons to limit a downward travel of the respective modular cylinder pistons in the respective modular cylinder sleeves, and the respective modular cylinder tubes are respectively connected to the respective lower piston travel limiters.

17. The modular subsurface lift engine as claimed in claim 12 wherein the upper crossover sleeve is elongated and houses a downstroke spring that constantly urges the modular subsurface lift engine to a bottom-of-stroke condition.

18. The modular subsurface lift engine as claimed in claim 12 further comprising a modular surface lift engine drive system that comprises:

a fluid pump adapted to continuously pump a lift fluid from a lift fluid reservoir at a predetermined rate; and at least two control valves for controlling a flow of the lift fluid so that lift fluid is supplied from the lift fluid reservoir to the isolated annulus during an upstroke of the modular subsurface lift engine and diverted to the lift fluid reservoir while lift fluid is drained from the isolated annulus to the lift fluid reservoir as the modular subsurface lift engine downstrokes.

19. The modular subsurface lift engine as claimed in claim 18 wherein the modular subsurface lift engine drive system comprises:

a lift fluid supply line connected between of the lift fluid reservoir and an input of the fluid pump;

a lift fluid pressure line connected to an output of the fluid pump and in fluid communication with the isolated annulus above the production packer;

a first control valve in the lift fluid pressure line adapted to control a flow of lift fluid through the lift fluid pressure line by selectively diverting the lift fluid to a lift fluid bypass line interconnecting the first control valve and the lift fluid reservoir during a downstroke of the modular lift engine;

a lift fluid dump line providing fluid communication between the annulus and the lift fluid reservoir;

a second control valve in the lift fluid dump line adapted to control lift fluid flow through the lift fluid dump line, to permit lift fluid to flow through the lift fluid dump line only during the downstroke of the modular lift engine;

a control circuit for controlling the first and second control valves; and at least one lift fluid pressure sensor connected to the control circuit, the lift fluid pressure sensor sensing a pressure of the lift fluid in the isolated annulus.

20. A modular subsurface lift engine, comprising:

at least one subsurface lift engine module adapted to be connected end-to-end to other subsurface lift engine modules, each subsurface lift engine module comprising:

a modular cylinder sleeve having an open top end, a cylinder sleeve bottom wall with a central passage therein, and at least two cylinder sleeve ports adjacent the cylinder sleeve bottom wall to provide fluid communication through the modular cylinder sleeve with a modular cylinder lift chamber;

a modular cylinder piston with a modular piston seal that provides a high-pressure fluid seal between an inner wall of the modular cylinder sleeve and the modular cylinder piston, the modular cylinder piston having an upper travel limiter and a lower travel limiter to limit travel of the modular cylinder piston in the modular cylinder sleeve;

a modular cylinder tube connected to the bottom travel limiter of the modular cylinder piston and extending through a high pressure fluid seal in the central passage in the modular cylinder bottom wall, the modular cylinder tube having at least two modular cylinder tube ports that provide fluid communication through a sidewall of the modular cylinder tube with a modular cylinder pump chamber above the modular cylinder piston in an adjacent lower modular cylinder sleeve;

an upper valve housing adapted to connect a production tubing supported by a wellhead of a cased well bore, the upper valve housing having an upper valve seat and an upper valve for controlling a flow of produced fluids through the subsurface lift engine during a down-stroke thereof;

an upper crossover sleeve connected to a bottom end of the upper valve housing;

an upper transition sleeve connected to a bottom end of the upper crossover sleeve, the upper transition sleeve having a bottom end connected to the at least one lift engine module, and further having an upper crossover tube that is connected to a bottom end of an upper transition travel limiter that reciprocates within the upper transition sleeve, the upper crossover tube extending through a central passage in a bottom of the upper transition sleeve; and a lower crossover sleeve having a lower valve housing with a lower valve seat and a lower valve for controlling a flow of produced fluid hydrocarbons through the subsurface lift engine during an up-stroke thereof, the lower crossover sleeve being adapted to connect to a production packer that isolates the subsurface lift engine from an annulus of the cased well bore below it, the production packer supporting a production tubing that extends downwardly to hydrocarbon fluids in the cased well bore.

* * * * *